US012590749B2

(12) United States Patent
Sixt

(10) Patent No.: US 12,590,749 B2
(45) Date of Patent: Mar. 31, 2026

(54) THERMALLY INSULATED TRANSPORT CONTAINER

(71) Applicant: Bernhard Sixt, Oberpframmern (DE)

(72) Inventor: Bernhard Sixt, Oberpframmern (DE)

( * ) Notice: Subject to any disclaimer, the term of this patent is extended or adjusted under 35 U.S.C. 154(b) by 168 days.

(21) Appl. No.: 18/267,176

(22) PCT Filed: Nov. 26, 2021

(86) PCT No.: PCT/EP2021/083249
§ 371 (c)(1),
(2) Date: Jun. 14, 2023

(87) PCT Pub. No.: WO2022/128420
PCT Pub. Date: Jun. 23, 2022

(65) Prior Publication Data

US 2024/0060700 A1 Feb. 22, 2024

(30) Foreign Application Priority Data

Dec. 17, 2020 (DE) ..... 10 2020 134 059.1

(51) Int. Cl.
*F25D 11/00* (2006.01)

(52) U.S. Cl.
CPC ..... *F25D 11/003* (2013.01); *F25D 2201/10* (2013.01)

(58) Field of Classification Search
CPC .... F25D 11/003; F25D 2331/804; F25D 3/08; B65D 81/3841
See application file for complete search history.

(56) References Cited

U.S. PATENT DOCUMENTS 3,108,840 A * 10/1963 Conrad ..... F17C 3/08 220/592.27
3,604,535 A 9/1971 Taylor
(Continued)

FOREIGN PATENT DOCUMENTS

| | | | |
|---|---|---|---|
| DE | 202006004344 | U1 | 6/2006 |
| EP | 2041402 | B1 | 10/2009 |
| WO | 02053967 | A1 | 7/2002 |

OTHER PUBLICATIONS

International Search Report for PCT/EP2021/083249 Mailed on Apr. 25, 2022.

*Primary Examiner* — Elizabeth J Martin
(74) *Attorney, Agent, or Firm* — Rivka Friedman

(57) ABSTRACT

The invention relates to a thermally insulated transport container (1). The invention is characterized in that the central refrigerated goods chamber (40) is surrounded by a plurality of decentralized refrigerated goods chambers (41, 42, 43, 44, 45, 46), the decentralized refrigerated goods chambers are connected or can be connected to the central refrigerated goods chamber (40) via a respective transfer gate (41', 42', 43', 44', 45', 46'), and the central refrigerated goods chamber (40) is equipped with a tubular ring slide device (6, 6') that can be rotated about a central axis (X) and has at least one transfer opening (65), which can be brought into register with a respective transfer gate by rotating the ring slide device, in the peripheral wall (62) of the ring slide device, thereby forming a passage from a paired decentralized refrigerated goods chamber to the central refrigerated goods chamber (40).

13 Claims, 7 Drawing Sheets

(56) References Cited

U.S. PATENT DOCUMENTS

| | | | | |
|---|---|---|---|---|
| 4,172,365 | A | 10/1979 | McClintock | |
| 2010/0000250 | A1* | 1/2010 | Sixt | A01N 1/148<br>220/592.2 |

* cited by examiner

THERMALLY INSULATED TRANSPORT CONTAINER

TECHNICAL FIELD

The present invention relates to a thermally insulated transport container according to the pre-characterising part of claim 1.

BACKGROUND OF THE INVENTION

In medicine and pharmacy, it is often necessary to transport frozen or deep-frozen samples or active ingredients over longer distances and periods of time without interrupting the cooling chain and without the temperature of these refrigerated goods rising above a permitted maximum temperature. Highly insulating frozen transport containers equipped with a cold accumulator are already known that are suitable for solving this task, for example the transport container for cooling frozen goods known from EP 2 041 502 B1.

In particular, however, when distributing vaccines that are to be kept deep-frozen or frozen (for example, at minus 70° C. to minus 80° C.), there is a problem in transporting a large number of small refrigerated containers, namely vaccine vials, to a vaccination site, for example, a doctor's office or a mobile vaccination station, where they are not required simultaneously, however, but individually and consecutively at intervals and are thus removed from the transport container. If the transport container is opened and closed again for each removal, warmer ambient air enters the cooling space inside the transport container during each removal process, which leads to a rapid reduction in the storage capacity of the cold accumulator and a significant reduction in the maximum cold holding time until the maximum permissible temperature for the goods is reached with each removal process.

DESCRIPTION OF THE PRIOR ART

DE 10 2007 008 351 A1 describes a self-cooling transport container which is equipped inside the cooling chamber with a revolver-like rotatable magazine with a plurality of refrigerated product receptacles arranged in a ring. A tubular access channel element is provided stationary in the transport container eccentrically above the ring of individual refrigerated product receptacles. By rotating the magazine, one refrigerated product receptacle at a time can be positioned below the tubular access element and then the refrigerated product can be removed from that refrigerated product receptacle through the access element. Providing such a rotatable magazine in a refrigerated container, in which temperatures of minus 70° C. to minus 80° C. may prevail, for example, requires a great deal of technical effort to ensure reliable rotatability even at such low temperatures. Moreover, the eccentric arrangement of the tubular access element is unfavourable from an insulation point of view. In addition, such a permanently installed removal mechanism makes it difficult to clean a transport container equipped with it, which is particularly disadvantageous if the transport container is intended for transporting medical and pharmaceutical products.

SUMMARY OF THE INVENTION

It is the object of the present invention to improve a generic thermally insulated transport container in such a way that even when transporting a large number of refrigerated goods receptacles, the respective removal of which takes place at intervals from one another, the maximum cold holding time is not seriously reduced.

This object is achieved by a thermally insulated transport container having the features of claim 1.

A thermally insulated transport container is provided with an outer housing enclosing an outer insulating chamber, an inner housing disposed inside the outer housing and enclosing an inner refrigerant chamber, and a refrigeration chamber disposed within the inner housing, the refrigeration chamber being connected to a tubular access channel element whose tubular interior opens into the refrigeration chamber and which can be closed by means of a closure insert, and the refrigeration chamber having a plurality of refrigerated goods chambers for receiving refrigerated goods. In this transport container, it is provided according to the invention that the refrigeration chamber has a central refrigerated goods chamber, which is surrounded by a plurality of decentral refrigerated goods chambers, that the tubular access channel element is arranged centrally in the outer housing and in the inner housing and is aligned with the central refrigerated goods chamber, and that the decentral refrigerated goods chambers are in communication or can be brought into communication with the central refrigerated goods chamber via a respective transfer gate.

ADVANTAGES

In this embodiment according to the invention, the removal of a refrigerated goods container always takes place from the central refrigerated goods chamber located in the axial center of the refrigeration chamber and thus from the central center of the inner housing surrounded by the refrigerant chamber. If warmer ambient air enters the central refrigerated goods chamber during a removal process, this results in a symmetrical thermal load on the refrigerant forming a cold accumulator and provided in the refrigerant chamber, as a result of which the storage capacity of the cold accumulator is only slightly stressed. In addition, the solution according to the invention does not require any complicated rotating mechanism, because when the central refrigerated goods chamber is empty, a refrigerated goods container can slide out of one of the decentralized refrigerated goods chambers through the associated transfer gate into the central refrigerated goods chamber by slightly tilting the transport container.

The transport container constructed according to the invention also has the advantage that the central tubular access channel element allows substantially unobstructed access to the cooling chamber even in the case of cleaning of the transport container. In particular, in the case of liquids leaking in the refrigeration chamber, reliable and uncomplicated cleaning of the refrigeration chamber is possible, especially if the surfaces in the refrigeration chamber are formed by a smooth wall, for example of stainless steel.

Preferably, a tubular ring slide device rotatable about a central axis is provided in the central refrigerated goods chamber, which has at least one transfer opening in its circumferential wall, which can be brought into overlap with a respective transfer gate by rotation of the ring slide device, whereby a passage is formed from a decentral refrigerated goods chamber associated with the transfer gate to the central refrigerated goods chamber. Such a ring slide device enables the targeted selection of a decentral refrigerated goods chamber by bringing the transfer opening of the ring slide device into overlap with the transfer gate of a selected decentral refrigerated goods chamber, whereby only one refrigerated goods container from this decentral refrigerated goods chamber can enter the central refrigerated goods chamber. The transfer gates of all other decentral refrigerated goods chambers are thereby closed by the wall of the ring slide device, so that also no warmer ambient air entering the central refrigerated goods chamber as a result of the removal process can enter into these closed decentral refrigerated goods chambers. The ring slide device can be easily removed by pulling it out of the interior of the tubular access channel element. This facilitates both cleaning of the interior and the central and decentralized refrigerated goods chambers, and also enables rapid cooling of the cold accumulator.

The central ring slide device can preferably be inserted into the central tubular access channel element so that it can be removed in the axial direction. This makes it possible to remove the entire ring slide device for cleaning purposes, for example, which also facilitates access to the refrigeration chamber for cleaning purposes.

It is particularly advantageous if the ring slide device engages in the interior of the tubular access channel element with an end pointing away from the base of the central refrigerated goods chamber. In this way, especially if the section of the ring slide device engaging in the access channel element is additionally sealed against the inner circumference of the tubular access channel element by means of a shaft seal, no air is introduced from the access channel element into the decentral refrigerated goods chambers, and convection-induced air exchange between the interior of the access channel element and the decentral refrigerated goods chambers is also reliably prevented.

A particularly advantageous embodiment of the invention, which can be combined with other embodiments, is one in which the ring slide device is provided at its end face facing away from the base of the central refrigerated goods chamber with coupling means which are designed for rotationally fixed coupling with mating coupling means provided on an end face of a tubular actuating element, the tubular actuating element being insertable into the tubular access channel element. The actuating element can thereby be removed from the tubular access channel element when not in use and thus not forms a thermal bridge when the access channel element is closed with a closing insert, for example with an insulating plug.

According to a further preferred embodiment of the invention, which can be combined with other embodiments, the outer housing and the inner housing as well as the central refrigerated goods chamber and the tubular access channel element have a circular-cylindrical shape and are arranged coaxially to one another, the decentral refrigerated goods chambers being arranged in a star shape around the central refrigerated goods chamber. This circular symmetrical design results in particularly effective and uniform insulation of the refrigerated goods chambers.

It is particularly advantageous if the decentral refrigerated goods chambers are formed by refrigerated goods niches extending radially outwards from the central refrigerated goods chamber.

Furthermore, it is advantageous if the ring slide device has two tubular ring slide elements which are arranged coaxially one inside the other and each have at least one transfer opening in their circumferential wall and which can be rotated relative to one another. This coaxial arrangement of two ring slide elements, which can be rotated relative to one another and each have at least one transfer opening, makes it possible to bring a transfer opening of the inner ring slide element and a transfer opening of the outer ring slide element into alignment with one another in order to form a common transfer opening of the ring slide device, which can then be brought into alignment with a transfer gate of a decentral refrigerated goods chamber in order to open this decentral refrigerated goods chamber towards the central refrigerated goods chamber. However, it is also possible to twist the two ring slide elements against each other in such a way that their transfer openings do not overlap, whereby the tube wall of the ring slide device is closed and all decentral refrigerated goods chambers are shielded from the central refrigerated goods chamber.

In a particularly preferred embodiment of the invention, which can be combined with other embodiments, the outer housing has a cup-like outer housing base body closed by means of an outer cover wall, and the tubular access channel element is connected to the outer cover wall. The inner housing base body connected to the tubular access channel element is inserted into the outer housing base body, and the outer wall thereof defines an inner space of the outer housing base body together with the wall of the tubular access channel element, the wall of the outer housing base body, and the outer cover wall. This outer interior space of the outer housing base body is evacuated and therefore has particularly good thermal insulation properties. Preferably, the outer interior space is filled with a poorly thermally conductive mechanical support means in order to be able to more effectively support the pressure forces of the ambient air pressure acting on the wall of the outer housing base body in the evacuated vacuum or negative pressure state. In addition, the supporting agent, in particular fumed silica as a supporting agent, restricts the free paths of any individual gas molecules that may still be present in the interior at a high vacuum, so that even in this case a high degree of insulation is achieved.

A likewise preferred embodiment of the invention, which can also be combined with other embodiments, is characterized in that the inner housing has a cup-like inner housing base body which is closed by means of an inner cover wall, and in that the tubular access channel element is connected to the inner cover wall. The inner housing base body forms a refrigerating insert, the wall of which surrounds the refrigeration chamber and is connected to the tubular access channel element, the interior of which opens into the refrigeration chamber. The interior of the inner housing base body is filled with a refrigerant or refrigeration elements filled with refrigerant are inserted into this inner interior space.

If the inner housing base body is designed to be horizontally separable, the refrigerating elements provided with the refrigerant can be inserted into the inner interior space during assembly. Preferably, different housing base body elements of the inner housing base body are provided and can be combined with each other, defining different sized inner interior spaces, so that different numbers or sizes of refrigerating elements can be accommodated by the inner interior space. The refrigerating capacity can thus be adapted to requirements during assembly, and different transport containers with different refrigerating capacities can be manufactured in a simple and cost-effective manner in a modular system.

Preferred embodiments of the invention with additional design details and further advantages are described and explained in more detail below with reference to the accompanying drawings.

BRIEF DESCRIPTION OF THE DRAWINGS

It shows.

DETAILED DESCRIPTION OF PREFERRED EMBODIMENTS OF THE INVENTION

Figure 1:
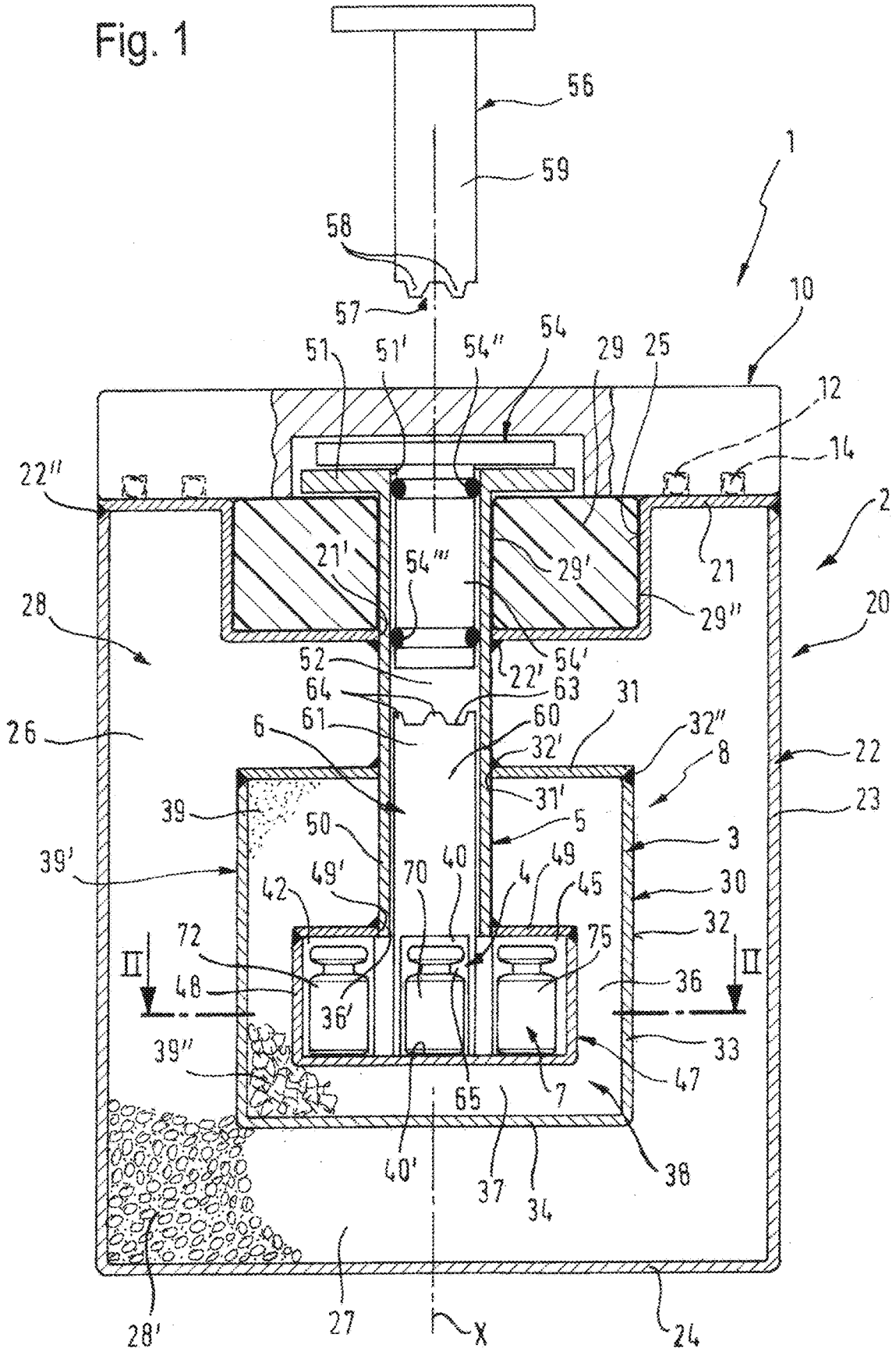
FIG. 1 a vertical section through a thermally insulated transport container according to the invention with the ring slide device shown uncut.

In FIG. 1, a circular cylindrical thermally insulated transport container 1 according to the invention is shown in a vertical section. However, the invention is not limited to a circular cylindrical embodiment; the transport container may also have an oval, rectangular or otherwise polygonal layout, although the circular cylindrical shape is preferred and is particularly thermally advantageous due to rotational symmetry.

An outer housing 2 of the transport container 1 comprises a cup-shaped outer housing base body 20, which is rotationally symmetrical with respect to a vertical central axis X, and an annular outer cover wall 21 closing the outer housing base body 20. The outer housing 2 is formed by a wall 22, preferably of poorly heat-conducting stainless steel, which has a cylindrical outer wall 23 and a substantially flat bottom wall 24 of the housing base body 20 and the annular cover wall 21.

An inner housing 3, described in further detail below, is inserted into the cup-like housing base body 20. The inner housing 3 provided inside the outer housing base body 20 and a tubular access channel element 5 connected thereto are surrounded by the outer housing 2 defining an insulating chamber 28 and form a refrigerant insert 8. The tubular access channel element 5 opens into the inner opening 21' of the stepped annular outer cover wall 21 and is hermetically welded thereto (weld seam 22'). The circumferential wall 23 of the cup-like housing base body 20 and the cover wall 21 are also hermetically welded to each other (weld seam 22") to ensure a high vacuum tightness of the outer insulating chamber 28. The wall 22 of the outer housing 2 encloses an annular space 26 surrounding the inner housing 3 and the access channel element 5 and a bottom space portion 27, which together form the outer insulating chamber 28.

The outer insulating chamber 28 can be evacuated by means of an evacuation valve (not shown) provided in the wall 22 and a vacuum pump (also not shown). During operation of the thermally insulating transport container 1 according to the invention, a vacuum prevails in the outer insulating chamber 28.

To prevent the compressive forces of the ambient pressure acting on the wall 22 from deforming or even collapsing the wall 22, the entire insulating chamber 28 is filled with a vacuum support material 29 that is a poor conductor of heat and can withstand mechanical pressure, for example with pyrogenic silica, which is indicated in FIG. 1 only in a lower region of the insulating chamber 28 as an example. The provision of this vacuum support material 29 in the insulating chamber 28 allows the wall thickness of the wall 22 to be kept low in order to reduce heat conduction along the wall 22 without reducing its mechanical stability.

The inner housing 3, which is arranged coaxially with respect to the central axis X, comprises a cup-like inner housing base body 30 and an annular inner cover wall 31 closing the latter. The inner housing 3 has a wall 32, which is preferably made of poorly heat-conducting material, for example stainless steel, and comprises a cylindrical outer wall 33 and a substantially planar base wall 34 of the cup-like inner housing base body 30 and the inner cover wall 31 closing the latter at the top. A refrigeration chamber housing 47, which surrounds a refrigeration chamber 4 for refrigerated goods 7 to be transported and which is described in further detail below, is inserted into the cup-like inner housing base body 30. The tubular access channel element 5 passes through the inner opening 31' of the annular inner cover wall 31 and is hermetically welded thereto (weld seam 32'). The peripheral wall 33 of the cup-like housing base body 30 and the cover wall 31 are also hermetically welded to each other (weld seam 32") to ensure a high vacuum tightness of the outer insulating chamber 28. The wall 32 of the inner housing 3 and the wall 50 of the tubular access element 5 enclose an annular space 36 surrounding the refrigeration chamber housing 47 and a bottom space portion 37, which together form an inner refrigerant chamber 38. The inner refrigerant chamber 38 is filled with an organic refrigerant 39 and forms a cold accumulator 39'.

Preferably, the refrigerant chamber 38 contains a metal wool filling 39" with good thermal conductivity. For reasons of clarity, the metal wool filling 39" is shown in FIG. 1 only in part of the refrigerant chamber 38, although preferably the entire refrigerant chamber 38 is provided with the metal wool filling 39". Instead of the metal wool filling 39", a filling of good heat-conducting metal foam, for example aluminium foam, or another good heat-conducting spatial metal grid can also be provided in the refrigerant chamber 38. Preferably, the organic refrigerant used is a material that undergoes a phase transformation from the solid state to the liquid state in the temperature range from −15° C. to −100° C. and has a heat of fusion of, for example, at least 50 J/ml.

The refrigeration chamber 4 surrounded by the refrigeration chamber housing 47 forms a receptacle for refrigerated goods 7 and has a central refrigerated goods chamber 40 as well as decentral refrigerated goods chambers arranged in a star shape around it, as will be described further below with reference to FIG. 2. The refrigeration chamber housing 47, which is arranged coaxially with respect to the central axis X, has a cup-shaped refrigeration chamber housing base body 48 and an annular upper cover wall 49, which closes the latter and has a central opening 49'. The wall of the refrigeration chamber housing 47 comprising the refrigeration chamber housing base body 48 and upper cover wall 49 is preferably formed from a material with good thermal conductivity, for example aluminium, in order to ensure effective cold input from the refrigerant chamber 38 into the refrigeration chamber 4.

The tubular access channel element 5 extends coaxially to the central axis X from above through the central, inner opening 21' of the outer cover wall 21, to the edge of which it is hermetically welded, through the central, inner opening 31' of the inner cover wall 31, to the edge of which it is also hermetically welded, downwardly to the central opening 49' of the annular upper cover wall 49 of the refrigeration chamber housing 47, where the cylindrical wall 50 of the tubular access channel element 5, preferably consisting of poorly heat-conducting stainless steel, is firmly and tightly connected to the annular upper cover wall 49, preferably consisting of aluminium. The interior 52 of the access channel element 5 thus opens into the refrigeration chamber 4.

At its upper end region facing away from the refrigeration chamber 4, the cylindrical wall 50 of the tubular access channel element 5 is surrounded by an annular insulating body 29, the radial inner wall 29' of which bears firmly against the cylindrical wall 50 of the access channel element 5 and thus connects the insulating body 29 to the access channel element 5 in a rotationally and axially fixed manner. An upper flange ring 51 forms the upper end of the cylindrical wall 50 facing away from the central refrigerated goods chamber 40 and surrounds an upper opening 51' of the access channel element 5. The upper flange ring 51 rests on the annular insulating body 29 and does not extend radially outwardly beyond the annular insulating body 29. The radial outer wall 29" of the insulating body 29 is fitted accurately into an annular recess 25 formed by the annular stepped outer cover wall 21 of the outer housing 2. The annular insulating body 29, which is a very poor conductor of heat, ensures that the access channel element 5 is received and held in the outer housing base body 2 without permitting any appreciable heat exchange between these bodies.

To close the upper opening 51' of the tubular access channel element 5, a closure insert 54 is provided, for example in the form of an insulating plug, which projects with an insulating shaft 54' into the interior 52 of the tubular access channel element 5 and fills it either partially or completely in the vertical length. The insulating shank 54' of the closure insert 54 is preferably designed as a hollow cylinder which is filled with a moisture adsorbent, for example with absorbent cotton or felt, in its cavity which is open downwards (towards the refrigeration chamber 4) in order to absorb therewith any liquid which may escape. At its upwardly projecting end, the closure insert 54 is sealed against the inner wall of the access channel element 5 by a neck gasket 54". A further peripheral gasket 54" is provided in the lower region of the insulating shaft 54', which also seals against the inner wall of the access channel element 5.

An outer container lid 10 can be firmly connected to the outer housing 2 and is supported against the upper cover wall 21 of the outer housing 2 by annular seals 12, 14 shown only schematically in FIG. 1. Preferably, the sealing of the outer container lid 10 to the outer housing 2 is implemented as in EP 2 041 502 B1, originating from the inventor, to whose disclosure in this respect reference is expressly made and which is thereby included in the disclosure of the present application.

Figure 2:
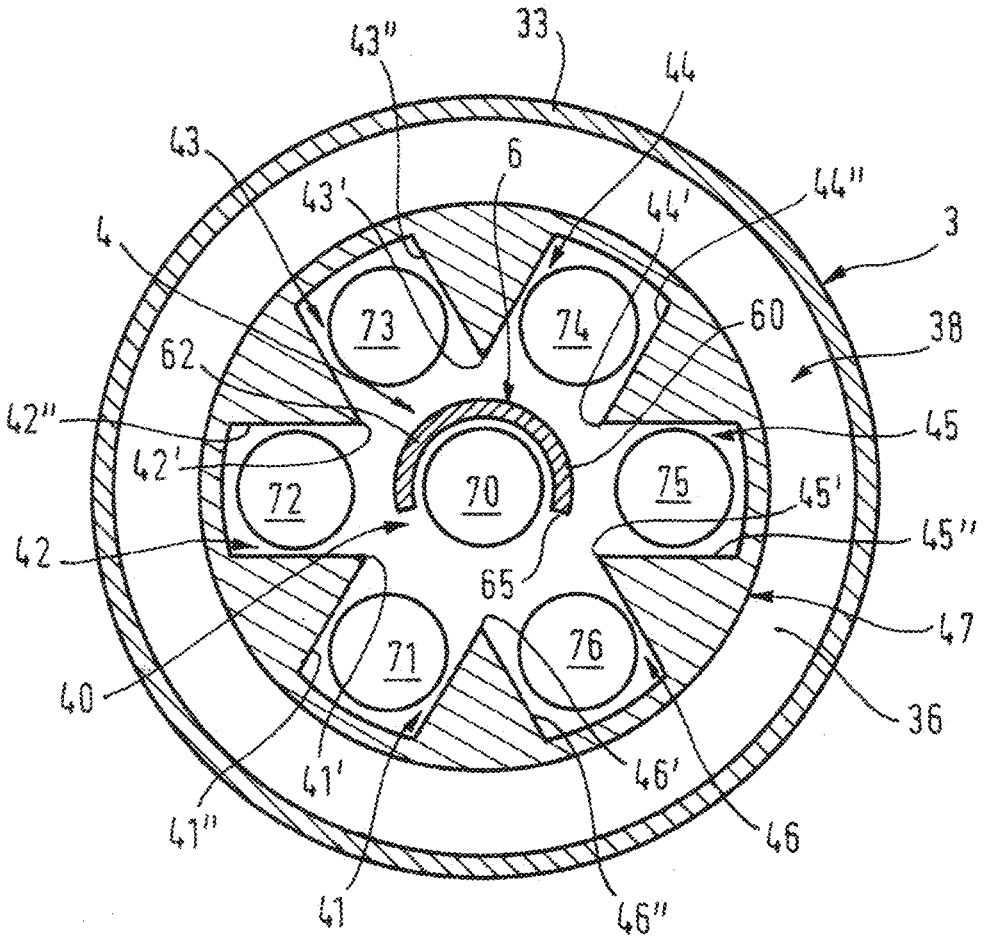
FIG. 2 a horizontal section through the inner housing of the thermally insulated transport container from FIG. 1 along line II-II.

FIG. 2 shows a horizontal section through the inner housing 2 and the refrigeration chamber 4. The refrigeration chamber 4 has a central refrigerated goods chamber 40 for accommodating a refrigerated goods container 70, which is surrounded by six decentral refrigerated goods chambers 41, 42, 43, 44, 45, 46, which extend radially outwards from the central refrigerated goods chamber 40 in a star shape. Instead of six decentral refrigerated goods chambers, more or less decentral refrigerated goods chambers may also be provided. In this case, the decentral refrigerated goods chambers 41, 42, 43, 44, 45, 46 are formed by refrigerated goods niches 41", 42", 43", 44", 45", 46" extending radially outward from the central refrigerated goods chamber and formed by the inner wall of the inner housing.

The respective opening of each decentral refrigerated goods chamber 41, 42, 43, 44, 45, 46 into the central refrigerated goods chamber 40 forms a transfer gate 41', 42', 43', 44', 45', 46' through which a refrigerated goods container 71, 72, 73, 74, 75, 76 can be moved when filling the refrigeration chamber 4 from the central refrigerated goods chamber 40 into the associated decentral chamber 41, 42, 43, 44, 45, 46 and by means of which, when refrigerated goods containers 71, 72, 73, 74, 75, 76 are removed from a respective decentral chamber 41, 42, 43, 44, 45, 46, the relevant refrigerated goods container 71, 72, 73, 74, 75, 76 can be transferred back into the central chamber 40. The respective decentral refrigerated goods chamber 41, 42, 43, 44, 45, 46 can also be dimensioned in such a way that it accommodates more than the one refrigerated goods container 71, 72, 73, 74, 75, 76 shown in FIG. 2. Preferably, then, a plurality of refrigerated goods containers are arranged one behind the other in the radial direction within a refrigerated goods chamber 41, 42, 43, 44, 45, 46. The refrigerated goods chambers 41, 42, 43, 44, 45, 46 can-alternatively or additionally—also be dimensioned in such a way that several refrigerated goods containers are arranged one above the other and can be removed together as a stack when the height of the transfer gates 41', 42', 43', 44', 45', 46' and the transfer openings 65, 67 (FIG. 3) is adapted to the height of the decentral refrigerated goods chambers 41, 42, 43, 44, 45, 46. The decentral refrigerated goods chambers 41, 42, 43, 44, 45, 46 can also be equipped with one or more horizontal intermediate shelves (not shown), so that refrigerated goods containers can be accommodated on several levels in the decentral refrigerated goods chambers 41, 42, 43, 44, 45, 46. The transfer openings 65, 67 (FIG. 3) can then be designed to extend circumferentially offset in a step-like manner in the longitudinal direction of the relevant ring slide element 60, 66 (FIG. 3) in accordance with these levels, in order to specifically allow access to only one of the levels.

A tubular ring slide device 6, rotatable about the central axis X, is provided in the central refrigerated goods chamber 40 and comprises a ring slide element 60 having a tubular circumferential wall 62. The outer diameter of the tubular circumferential wall 62 is thereby dimensioned such that the ring slide element 60 is accurately but rotatably received within the tubular access channel element 5. The circumferential wall 62 of the ring slide element 60 has at least one transfer opening 65 in the lower region, the dimensions of which substantially correspond to the dimensions of a respective transfer gate 41', 42', 43', 44', 45', 46'. By rotating the ring slide element 60, the transfer opening 65 can be brought into overlap with any transfer gate 41', 42', 43', 44', 45', 46', thereby creating a passage for a refrigerated goods container 71, 72, 73, 74, 75, 76 from an associated decentral refrigerated goods chamber 41, 42, 43, 44, 45, 46 to the central refrigerated goods chamber 40, as can be seen in FIG. 2.

The ring slide element 60 of the ring slide device 6 engages in the interior 52 of the tubular access channel element 5 with an upper end 61 pointing away from the bottom 40' of the central refrigerated goods chamber 40. At its upper end face 63 pointing away from the bottom 40' of the central refrigerated goods chamber 40, the ring slide device 60 is provided with coupling means 64 distributed over the circumference and projecting in the axial direction from the upper end face 63, which are designed for rotationally fixed coupling with counter coupling means 58 provided on a lower end face 57 of the circumferential wall 59 of a tubular actuating element 56, wherein the tubular actuating element 56—after removal of the closure insert 54—can be introduced from above into the tubular access channel element 5 and can be rotationally fixedly coupled to the ring slide element 60. The ring slide element 60 can then be rotated by means of the actuating element 56.

Figure 3:
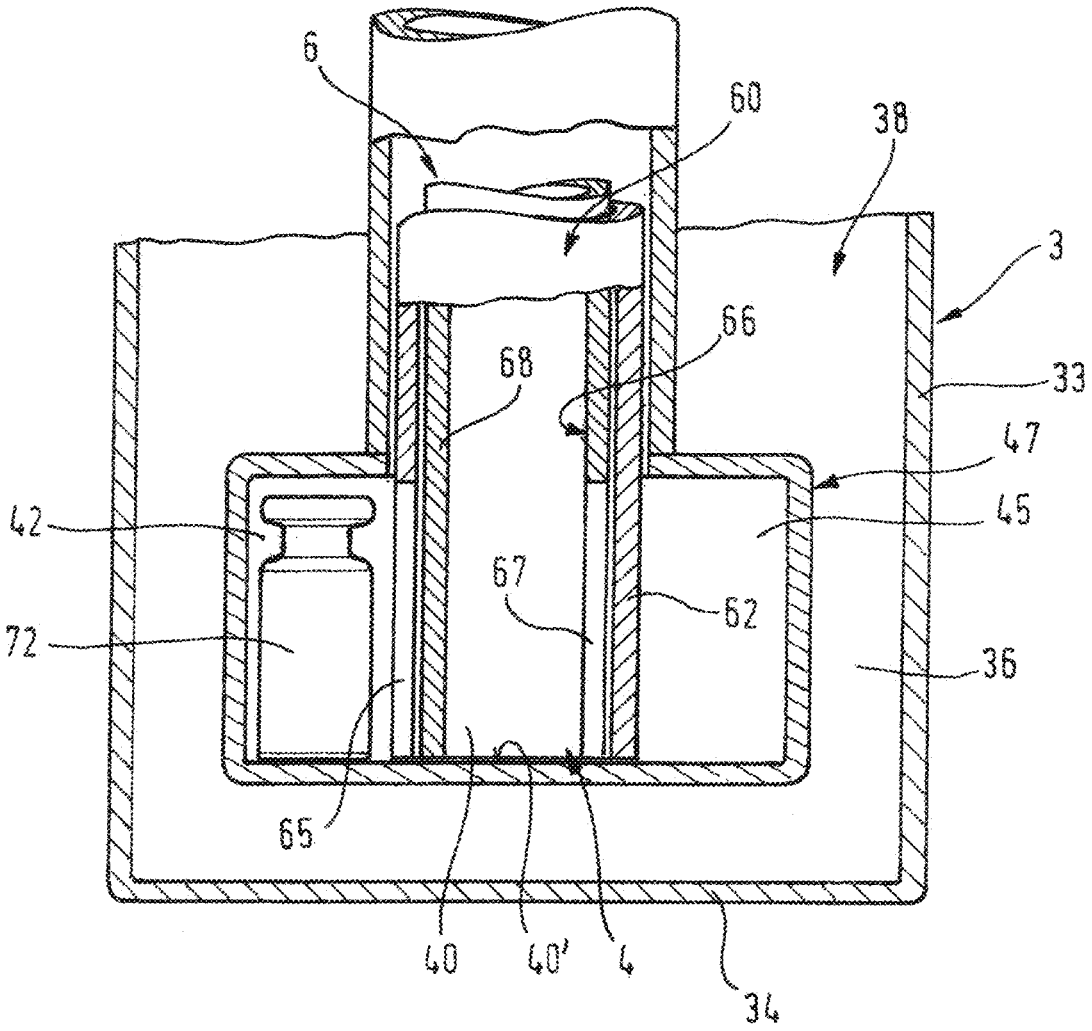
FIG. 3 a vertical section through the inner housing of a thermally insulated transport container according to the invention with a first modified ring slide device in enlarged view.

A modified embodiment is shown in FIG. 3, in which the ring slide device 6 additionally has an inner ring slide element 66 with a tubular circumferential wall 68 inside the outer ring slide element 60, these two ring slide elements being rotatable relative to one another. The inner ring slide element 66 also has at least one transfer opening 67 in its circumferential wall 68 in the lower region, the dimensions of which transfer opening 67 correspond substantially to the dimensions of a respective transfer gate 41', 42', 43', 44', 45', 46' and thus also to the transfer opening 65 of the outer ring slide element 60.

An inner actuating element (not shown) is also provided for the inner ring slide element 66, which is rotatably arranged radially inside the circumferential wall 59 of the outer actuating element 56 and which is designed in the same way as the outer actuating element 56. Consequently, the inner actuating element can likewise be coupled in a rotationally fixed manner to the inner ring slide element 66 by corresponding (not shown) coupling and counter-coupling means.

The two ring slide elements 60, 66 are rotatable relative to each other in this manner to either close all transfer gates 41', 42', 43', 44', 45', 46' or open a selected transfer gate. Alternatively, the two ring slide elements can be coupled to one another in the direction of rotation in such a way that when one of the ring slide elements, for example the outer ring slide element 60, is rotated in a first direction of rotation about the vertical central axis X from a position in which the two transfer openings 65, 67 are aligned with one another, the other ring slide element 66 does not initially rotate with it, in order thereby to rotate the transfer openings with respect to one another again and thereby close them. Only then do both ring slide elements 60, 66 rotate together and synchronously with each other and with closed transfer openings 65, 67 further in the first direction of rotation. A rotation in a second direction of rotation opposite to the first direction of rotation can then again cause a relative movement between the two ring slide elements 60, 66 so that the transfer openings 65, 67 open again and a further rotation of the two ring slide elements 60, 66 together and synchronously with each other and with open transfer openings 65, 67 takes place further in the second direction of rotation. In this way, a trailing gate operation of the two ring slide elements coupled to each other is made possible.

Figure 4:
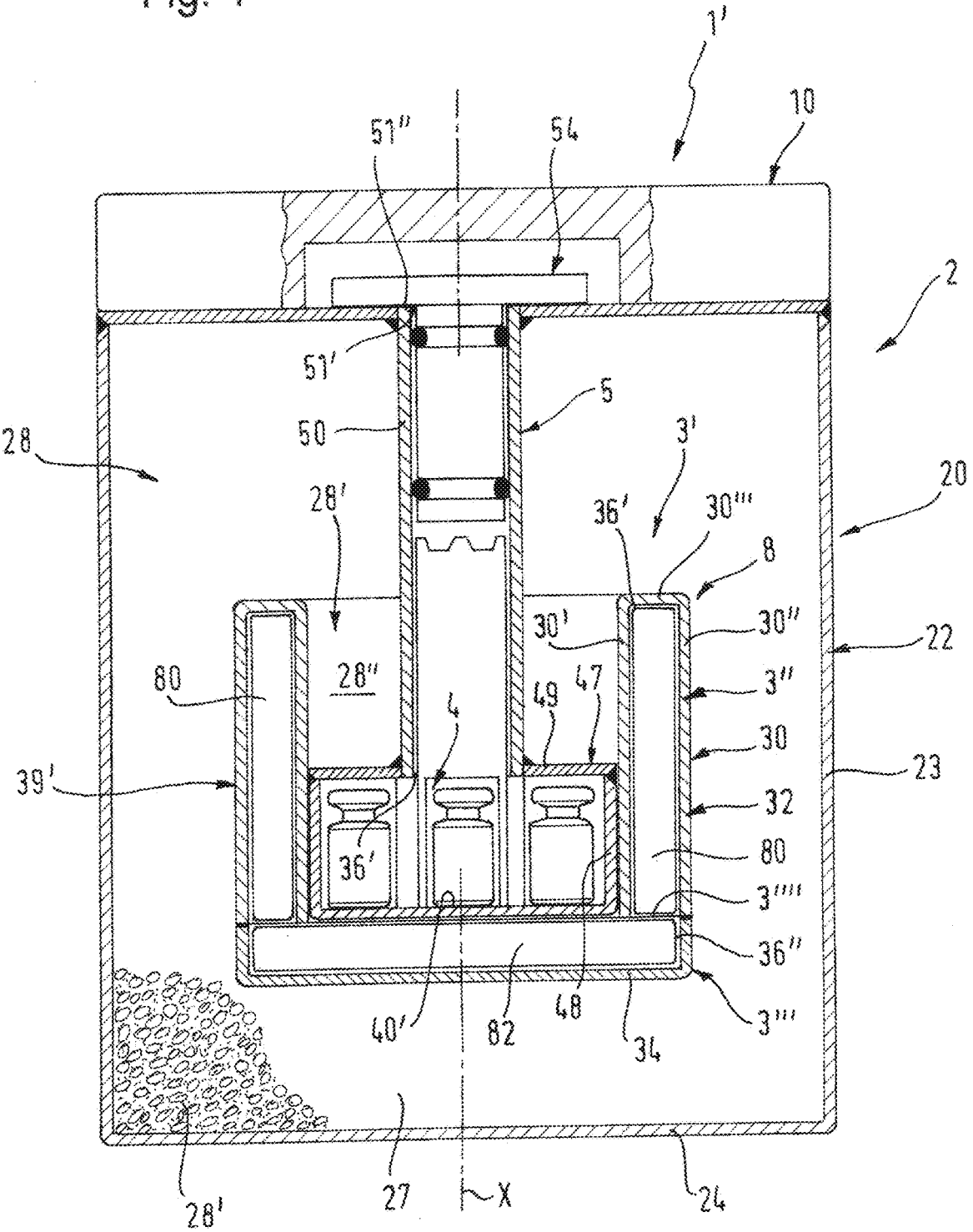
FIG. 4 a vertical section through a first alternative embodiment of a thermally insulated transport container according to the invention.
Figure 5:
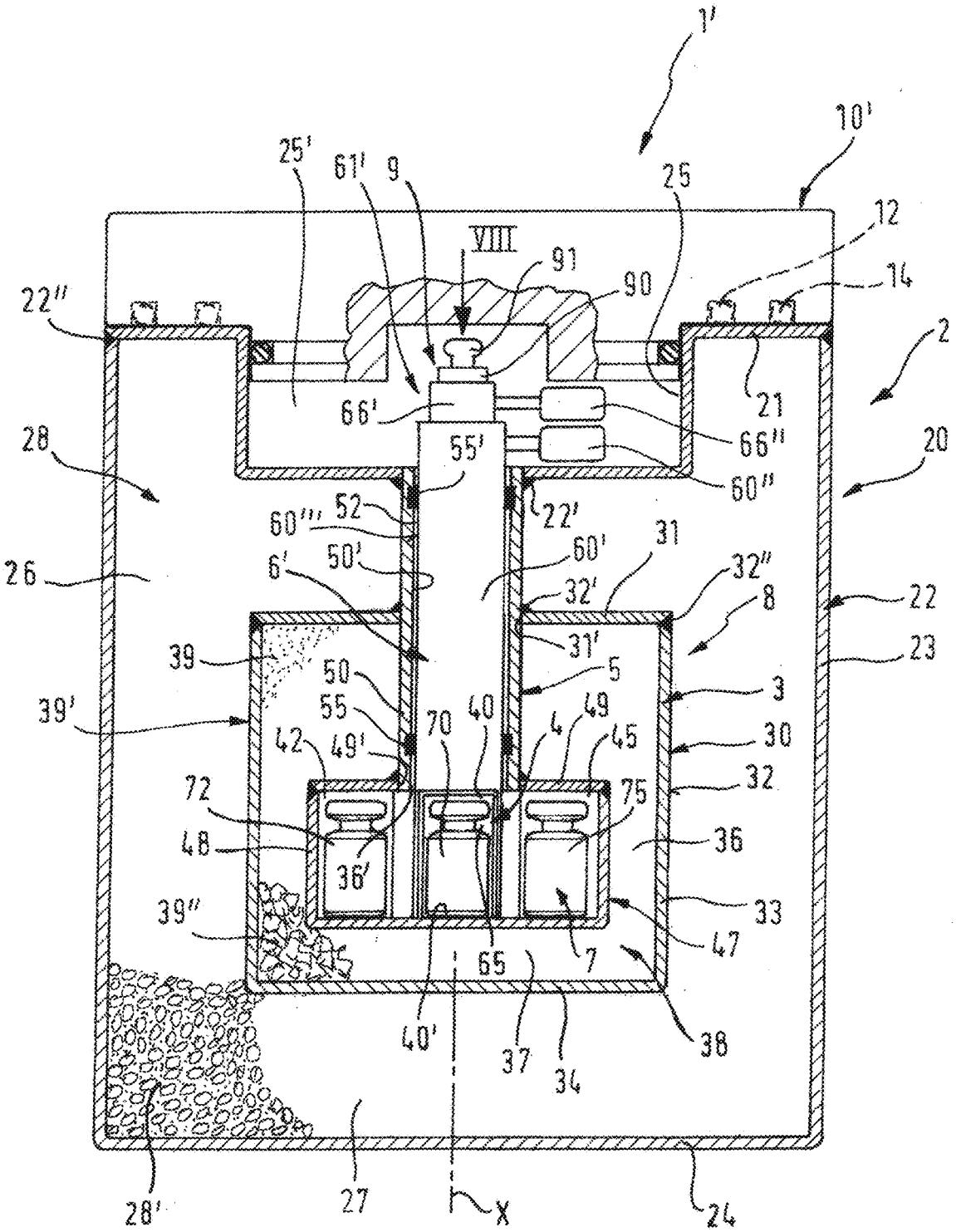
FIG. 5 a vertical section through a second alternative embodiment of a thermally insulated transport container according to the invention with a second modified ring slide device and a unloading slider.
Figure 6:
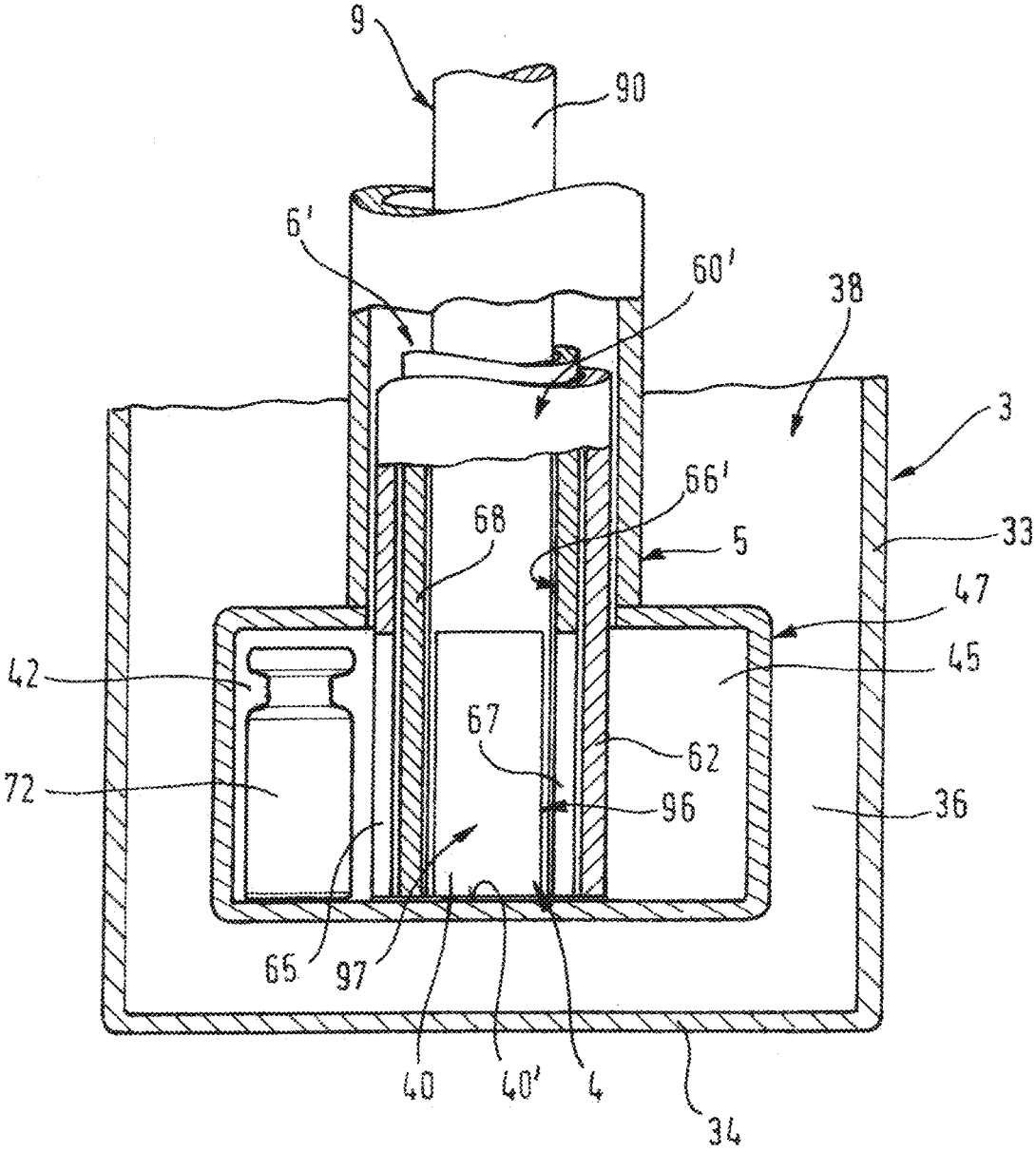
FIG. 6 a vertical section through the inner housing of the thermally insulated transport container of FIG. 5 with the second modified ring slide device and the unloading slider in enlarged view.
Figure 7:
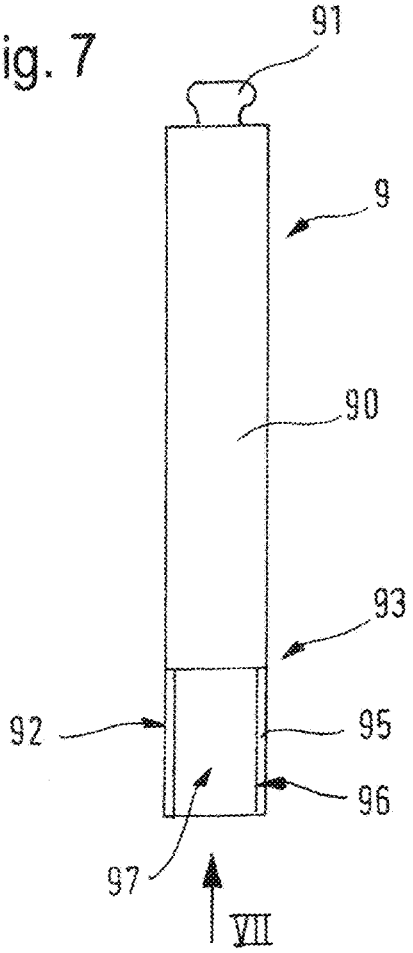
FIG. 7 shows a side view of the unloading slider.
Figure 7A:
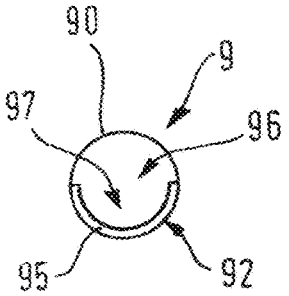
FIG. 7A axial view of the unloading slider in the direction of arrow VII in FIG. 7 and FIG. 8 a top view of the ring slide device provided with the unloading slider in the direction of arrow VIII in FIG. 5.

An alternative embodiment of a thermally insulated transport container 1' according to the invention with a modified inner housing 3' compared to the embodiment in FIG. 1 is shown in vertical section in FIG. 4. The inner housing 3' is designed in two parts and has an upper housing part 3" designed as a double-walled tube and a cup-like lower housing part 3'", which are joined together in a sealing manner along a partition line 3"". The upper housing part has a radially inner tube wall 30' and a radially outer tube wall 30", which are connected to one another at their respective upper end facing away from the cup-like housing part 3'" by an end wall 30'". A cylindrical annular space 36' is thus formed in the upper housing part 3", which—as in the embodiment example of FIG. 1—can be filled with refrigerant or into which refrigeration elements 80 filled with refrigerant can be inserted with a precise fit and with heat-conducting contact to the inner wall 32. The cavity 36" formed by the cup-like lower housing part 3'" of the inner housing 3' can also be filled with refrigerant—as in the embodiment example of FIG. 1—or at least one circular disc-shaped refrigerating element 82 filled with refrigerant can be inserted into this cavity with a precise fit. By the way, such refrigeration elements can also be used in the cold accumulator 39' of the variant according to FIG. 1.

A lower section of the upper housing part 3" has the refrigeration chamber housing 47 inserted, for example shrink-fitted, into it. The overlying upper portion of the upper housing part 3" radially inwardly adjoins an inner annular cylindrical portion 28' of the outer insulating chamber 28, which forms an insulating space between the upper housing part 3' and the tubular access channel element 5. The lower end of the cylindrical wall 50 of the tubular access channel element 5 is tightly and firmly connected to a refrigeration chamber housing 47, which is preferably made of aluminium and surrounds the refrigeration chamber 4.

FIG. 5 to FIG. 8 show a modified embodiment of the transport container according to the invention compared to the examples in FIG. 1 to FIG. 4. Parts and components unchanged from the examples described above have the same reference signs and the above description therefore applies to them in an analogous manner.

The ring slide device 6' with the outer ring slide element 60' and the inner ring slide element 66' corresponds in terms of its structure and mode of operation to the ring slide device 6 already described above, but the two ring slide elements 60', 66' extend not only into the tubular access channel element 5, but upwardly through it into an operating space 25' formed within the annular recess 25 of the ring-step-like outer cover wall 21 of the outer housing 2.

Figure 8:
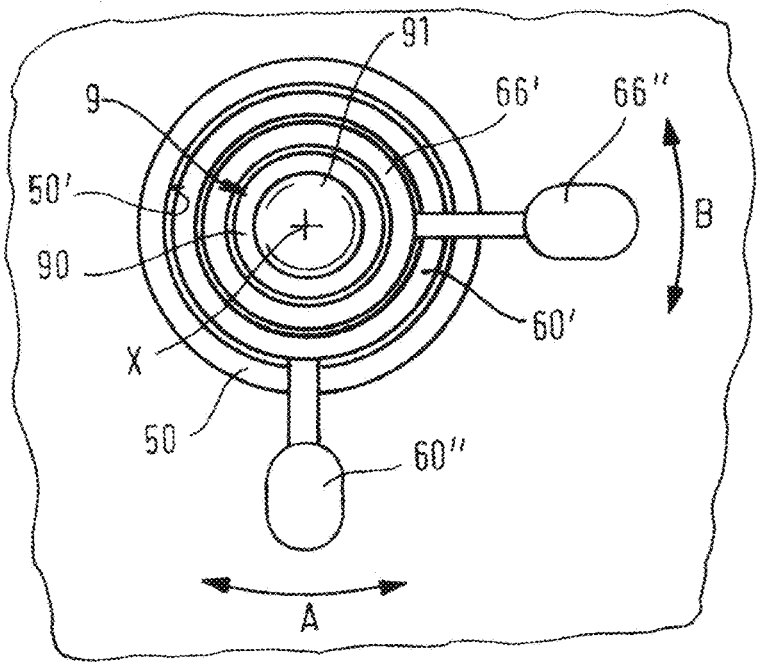

In the region of the upper end of the tubular outer ring slide element 60' facing away from the central cooling chamber 40, an actuating element 60" projecting radially outwardly is attached laterally thereto, which forms a lever with which the outer ring slide element 60' can be rotated manually in both directions within the access channel element 5 and relative thereto about the central axis X, as symbolized by the double arrow A in FIG. 8. At least one shaft seal 55, 55', for example a sealing ring, is provided between the radially inner surface 50' of the wall 50 of the access channel element 5 and the radially outer surface 60'" of the outer ring slide element 60'. As a result, the portion of the ring slide device 6' passing through the access channel element 5 is sealed against the inner circumference of the tubular access channel element 5, thus preventing air exchange between the refrigeration chamber 4 and the operating chamber 25', which improves the thermal insulation of the refrigeration chamber.

The tubular inner ring slide element 66' extends through the tubular outer ring slide element 60' in the axial direction into the operating chamber 25'. The upper end of the tubular inner ring slide element 66' projecting out of the outer ring slide element 60' and facing away from the central refrigeration chamber 40 is also provided with a radially outwardly projecting actuating element 66", which forms a lever with which the inner ring slide element 66' can be rotated manually in both directions within the outer ring slide element 60' and relative thereto about the central axis X, as symbolized by the double arrow B in FIG. 8. At least one—not shown—shaft seal can also be provided between the outer ring slide element 60' and the inner ring slide element 66'.

Centrally in the tubular inner ring slide element 66' and coaxially thereto is inserted a cylindrical unloading slider 9, displaceable in the direction of the central axis X, but non-rotatable and preferably sealing at the periphery. The unloading slider 9 has an upper shaft section 90, closed in cross-section, at the upper end of which, emerging from the ring slide device 6', an operating handle 91 is attached. A tubular section 92 provided with a lateral transfer opening 96 is provided at the free end 93 of the shaft section 90 of the unloading slider 9, which end can be introduced into the central refrigerated goods chamber 40 and forms a receiving and transport chamber 97 for a refrigerated goods container 70, 71, 72, 73, 74, 75, 76. A refrigerated goods container received therein can thus be removed from the refrigeration chamber or introduced into the refrigeration chamber by means of the unloading slider 9.

The wall 95 of this tubular section 92 is therefore interrupted by the transfer opening 96, which has the same dimensions in the circumferential direction (opening angle) as the transfer openings 65 and 67 of the two ring slide elements 60', 66'. The axial extent of the transfer opening 96 in the wall 95 of the removal slide 9 is preferably adapted to the axial length of the refrigerated goods containers 70, 71, 72, 73, 74, 75, 76, i.e. slightly larger than the latter, so that only one refrigerated goods container at a time can be received in the receiving and transport chamber 97. Such an unloading slider 9 is designed for the removal of a single refrigerated goods container at a time.

Since the unloading slider 9 is received in the inner ring slide element 66 in a rotationally fixed manner, the transfer openings 96 and 67 of the unloading slider 9 and the inner ring slide element 66 are always aligned with each other in the circumferential direction as soon as the removal slide is inserted far enough into the inner ring slide element 66.

Unloading sliders with an axially longer transfer opening 96 can also be provided for taller refrigerated goods containers or, if the decentral chambers 41, 42, 43, 44, 45, 46 each accommodate several refrigerated goods containers one above the other, for the removal of several refrigerated goods containers. For this case, in which a plurality of refrigerated goods containers are accommodated one above the other in a decentral refrigerated goods chamber, an unloading slider can also be provided, in which the axial extent of the transfer opening 96 corresponds substantially to the axial extent of the transfer gates 41', 42', 43', 44', 45', 46' and which thus forms an uploading slider for the refrigerated chambers. The interchangeability of the unloading slider 9 increases the flexibility of use of the transport container according to the invention.

Since the unloading slider 9 is closed in cross-section in its upper shaft section 90, when it is inserted into the inner ring slide element 66' it forms a sealing plug for the remaining through channel of the tubular access channel element 5 and thus-together with the tubular ring slide elements 60', 66'-seals the access channel element 5 and prevents cold from escaping from and heat from entering the refrigerated goods chambers. Both the shaft section 90 of the unloading slider 9 and the ring slide elements 60', 66' are preferably made of a material that does not conduct heat or conducts heat only very poorly, such as stainless steel, titanium or a plastic (e.g. Teflon).

To remove a refrigerated goods container from a decentral refrigerated goods chamber, the two ring slider elements 60', 66' are first rotated against each other in such a way that their transfer openings 65 and 67 are not aligned with each other, i.e. close each other. Then the transport container—with the outer container lid 10 removed—is brought into a lying position in which the central axis X runs horizontally and the cooling chamber from which the refrigerated goods container is to be removed is at the top. The entire ring slide device 6'—with transfer openings 65, 67 remaining closed—is then rotated so that the transfer opening 67 of the inner ring slide element 66' points upwards. By turning the outer ring slide element 60' so far that its transfer opening 65 is aligned with the transfer opening 67 of the inner ring slide element 66' and thus also with the transfer opening 96 of the unloading slider 9, a refrigerated goods container can fall downward from the decentral refrigerated chamber located above into the receiving and transport chamber 97 due to the force of gravity. Before the unloading slider 9 with the removed refrigerated goods container is now pulled out axially from the inner ring slide element 66', the outer ring slide element 60' is first rotated again relative to the inner ring slide element 66' in order to close the access to the decentral refrigerated chamber again and to prevent cold from escaping. The decentral refrigerated chambers are filled in the opposite way, also using gravity.

This procedure, made possible by the design of the ring slide device 6', makes it possible to use only gravity both for loading the decentral refrigerated chambers and for unloading them. It is therefore not necessary to provide any gripping devices in the transport container, which must have actuating means to be led out of the transport container, which would always form a thermal bridge or cold bridge.

Reference signs in the claims, the description and the drawings serve only for a better understanding of the invention and are not intended to limit the scope of protection.

LIST OF REFERENCE SIGNS

It denote:

1 thermally insulated transport container
2 outer housing
3 inner housing
3' inner housing
3" upper housing part
3'" lower housing part
3"" partition line
4 refrigeration chamber
5 tubular access channel element
6 ring slide device
6' ring slide device
7 refrigerated goods
8 refrigerant insert
9 unloading slider
10 outer container lid
12 ring seal
14 ring seal
20 outer housing base body
21 upper outer cover wall
21' inner opening.
22 wall
22' weld seam
22" weld seam
23 cylindrical outer wall
24 external bottom wall
25 annular recess
26 annular space

27 bottom space portion
28 outer insulating chamber
29 insulating body.
29' radial inner wall
29" radial outer wall
30 inner housing base body
30' inner tube wall
30" outer tube wall
31 inner cover wall
31 inner opening
32 wall
32' weld seam
32" weld seam
33 cylindrical outer wall
34 base wall
36 annular space
36' annular space
36" cavity
37 bottom space portion
38 inner refrigerant chamber
39 refrigerant
39' cold accumulator
39" metal wool filling
40 central refrigerated goods chamber
40' bottom
41 decentral refrigerated goods chamber
41' transfer gate
41" refrigerated goods niche
42 decentral refrigerated goods chamber
42' transfer gate
42" refrigerated goods niche
43 decentral refrigerated goods chamber
43' transfer gate
43" refrigerated goods niche
44 decentral refrigerated goods chamber
44' transfer gate
44" refrigerated goods niche
45 decentral refrigerated goods chamber
45' transfer gate
45" refrigerated goods niche
46 decentral refrigerated goods chamber
46' transfer gate
46" refrigerated goods niche
47 refrigeration chamber housing
48 refrigeration chamber housing base body
49 top cover wall
49' central opening
50 wall
50' radial inner surface of 50
51 flange ring
51' upper opening
52 interior
54 closure insert
54' insulating shaft
54" neck gasket
54'" peripheral gasket
56 actuating element
57 lower face of 56
58 countercoupling means
59 circumferential wall
60 outer ring slide element
60' outer ring slide element
60" actuating element
60'" radial outer surface of 60'
61 upper end of 6
61' upper end of 6'
62 tubular circumferential wall
63 upper end face
64 coupling means
65 transfer opening
66 inner ring slide element
66' inner ring slide element
66" actuating element
67 transfer opening
68 tubular circumferential wall
70 refrigerated goods container
71 refrigerated goods container
72 refrigerated goods container
73 refrigerated goods container
74 refrigerated goods container
75 refrigerated goods container
76 refrigerated goods container
80 refrigerating elements
82 circular disc shaped refrigerating element
90 upper shaft section
91 operating handle
92 tubular section
93 free end of 90
95 wall of 92
96 transfer opening
97 receiving and transport chamber
X vertical central axis.

The invention claimed is:

1. A thermally insulated transport container comprising an outer housing enclosing an outer insulating chamber, an inner housing disposed within said outer housing and enclosing an inner refrigerant chamber, and a refrigeration chamber housing disposed within said inner housing and enclosing a refrigeration chamber, said refrigeration chamber housing being connected to a closable tubular access channel element the interior of which opens into the refrigeration chamber, wherein the refrigeration chamber has a plurality of refrigerated goods chambers for receiving refrigerated goods, wherein the refrigeration chamber has a central refrigerated goods chamber, and wherein the tubular access channel element is arranged centrally in the outer housing and in the inner housing and is aligned with the central refrigerated goods chamber, characterized in that the central refrigerated goods chamber is surrounded by a plurality of decentral refrigerated goods chambers, wherein the decentral refrigerated goods chambers are in communication or brought into communication with the central refrigerated goods chamber via a respective transfer gate, and a tubular ring slide device rotatable about a central axis (X) is provided in the central refrigerated goods chamber, wherein the ring slide device has at least one transfer opening in its circumferential wall and the transfer opening is brought into overlap with a respective transfer gate by rotation of the ring slide device, whereby a passage is formed from an associated decentral refrigerated goods chamber to the central refrigerated goods chamber, wherein the inner refrigerant chamber is formed by an annular space surrounding the refrigerated chamber housing, that is enclosed by the wall of the inner housing and the wall of the tubular access channel element, and a bottom space portion.

2. The thermally insulated transport container according to claim 1,
characterized
in that the ring slide device engages in the interior of the tubular access channel element with an end facing away from the bottom of the central refrigerated goods chamber.

3. The thermally insulated transport container according to claim 1,
characterized
that the ring slide device is removably inserted into the closable tubular access channel element.

4. The thermally insulated transport container according to claim 1,
characterized
that the ring slide device is provided at its end face facing away from the bottom of the central refrigerated goods chamber with coupling means which are designed for rotationally fixed coupling with counter-coupling means provided at an end face of a tubular actuating element, the tubular actuating element being insertable into the tubular access channel element.

5. The thermally insulated transport container according to claim 1,
characterized
that the ring slide device extends with an end facing away from the bottom of the central refrigerated goods chamber through the tubular access channel element into an operating space formed between an upper cover wall of the outer housing and a cover, and
wherein the ring slide device is provided with at least one actuating means for rotational actuation of the ring slide device.

6. The thermally insulated transport container according to claim 1,
characterized
in that the ring slide device has a tubular ring slide element which has at least one transfer opening in its circumferential wall and which is rotated about the central axis (X) relative to the tubular access channel element.

7. The thermally insulated transport container according to claim 6,
characterized
in that within the tubular ring slide element and coaxially thereto a radially inner tubular ring slide element is provided, which also has at least one transfer opening in its circumferential wall and which is rotatable relative to the tubular access channel element and relative to the outer tubular ring slide element about the central axis (X).

8. The thermally insulated transport container according to claim 6,
characterized
in that a cylindrical unloading slider is provided which engages centrally in the ring slide device in the axial direction and can be displaced axially relative to the ring slide device, and
wherein the cylindrical unloading slider has a tubular section, in the wall of which at least one transfer opening is provided, which can be brought into overlap with the at least one transfer opening of the ring slide device.

9. The thermally insulated transport container according to claim 8,
characterized
in that the cylindrical unloading slider is provided radially inside the inner tubular ring slide element and coaxially therewith and is axially displaceable relative to the inner tubular ring slide element, and
wherein the inner tubular ring slide element is rotatable relative to the cylindrical unloading slider.

10. The thermally insulated transport container according to claim 8,
characterized
in that the cylindrical unloading slider has a shaft section which is closed in cross section and is made of a thermally insulating or poorly thermally conductive material, and
wherein the tubular section provided with the transfer opening is formed at the free end of the shaft section which is inserted into the central refrigerated goods chamber.

11. The thermally insulated transport container according to claim 1,
characterized
in that the outer housing and the inner housing as well as the central refrigerated goods chamber and the tubular access channel element have a circular-cylindrical shape and are arranged coaxially with respect to one another, and
wherein the decentral refrigerated goods chambers are arranged in a star shape around the central refrigerated goods chamber.

12. The thermally insulated transport container according to claim 11,
characterized
in that the decentral refrigerated goods chambers are formed by refrigerated goods niches extending radially outwardly from the central refrigerated goods chamber.

13. The thermally insulated transport container according to claim 11,
characterized
that the inner housing accommodates at least one refrigerating element of a refrigerating insert.

* * * * *